US005556298A

United States Patent [19]

Huang

[11] Patent Number: 5,556,298

[45] Date of Patent: Sep. 17, 1996

[54] CHRISTMAS LAMP SET

[76] Inventor: Shun-Feng Huang, No. 13, Lane 84, Nei Hu Road, Hsin-Chu City, Taiwan

[21] Appl. No.: 561,280

[22] Filed: Nov. 21, 1995

[51] Int. Cl.[6] ..... H01R 4/24

[52] U.S. Cl. ..... 439/419

[58] Field of Search ..... 362/227; 439/414, 439/419

[56] References Cited

U.S. PATENT DOCUMENTS 5,421,742 6/1995 Huang ..... 439/419

5,492,483 2/1996 Cheng et al. ..... 439/419

*Primary Examiner*—Carroll B. Dority

*Attorney, Agent, or Firm*—Morton J. Rosenberg; David I. Klein

[57] ABSTRACT

The present invention relates to a Christmas lamp set which comprises two conductors fixed inside a socket of the set, wherein above all the conductor fixed on the internal circumference of the socket is secured firmly and safely by means of a thread fencing portion and a plurality of thread retaining portions inside the socket so that the risk of its falling off or undersired connection between it and the other conductor is prevented.

3 Claims, 3 Drawing Sheets

CHRISTMAS LAMP SET

BACKGROUND OF THE INVENTION

A heretofore known Christmas lamp, as shown in FIG. 5, 6 and 7, comprises:

- a socket 10 which has a threaded circumference 101, a groove 104 opened on the threaded circumference 101, two through holes 102, 103 on the internal circumference of the bottom part, a pair of fixing holes 105 opened on the lower part;
- a bulb 50 which has a threaded copper portion 501 to be fixed inside the threaded circumference 101 of the socket 10;
- a long conductor 20 which has a penetrating end 201;
- a short conductor 30 which also has a penetrating end 301; and
- a bottom cover 40 which has two fixing bars 401 erecting vertically on the cover 40.

The long conductor 20 is inserted into the groove 104 of the socket 10 and fixed therein, the penetrating end 201 of the long conductor being inserted through the through hole 102 which is just under the groove 104; while the short conductor 30 is deposited inside the through hole 301, the penetrating end 301 and the other end of the short conductor 30 being outside the through hole 30, the end opposite to the penetrating end 301 being bent at angle of some degrees to connect with the bottom of the bulb 50.

An electric wire 60 is positioned between the socket 10 and the bottom cover 40 and fixed therein by means of the fixing holes 105 of the socket 10 and the fixing bars 401 of the bottom cover 40, the fixing bars 401 being inserted into the fixing holes 105 and gripped therein frictionally.

The close combination of the bottom cover 40 with the socket 10 is such that the penetrating ends 201, 301 will penetrate plastic cover of the electric wire 60 for electricity to be conducted therethrough.

However, the above socket has disadvantages as follows:

1. the long conductor 20 can't be fixed firmly in the groove 104 that it is subject to shaking and consequent fall-off when the Christmas lamp set is moved;
2. the upper part of the long conductor 20 readily falls off the groove 104 and bends downward that when the bulb 50 is inserted into the socket 10, the long conductor 20 is often pressed down by the bulb 50 and consequently connects with the other socket 30; thus the lamp set shorts and catches fire.

SUMMARY OF THE INVENTION

According to the disadvantages of the above lamp set, a Christmas lamp set of the present invention is provided wherein a socket is provided with a trench fenced with a plurality of threads of a threaded wall thereon so that a conductor inserted into the trench won't fall off or be bent.

Furthermore a gap opened on lower portion of the socket is provided to prevent the conductor fixed with the trench from moving.

BRIEF DESCRIPTION OF THE DRAWINGS

The invention will be better understood by reference to the accompanying drawings, wherein.

DESCRIPTION OF THE PREFERRED EMBODIMENTS

Figure 3:
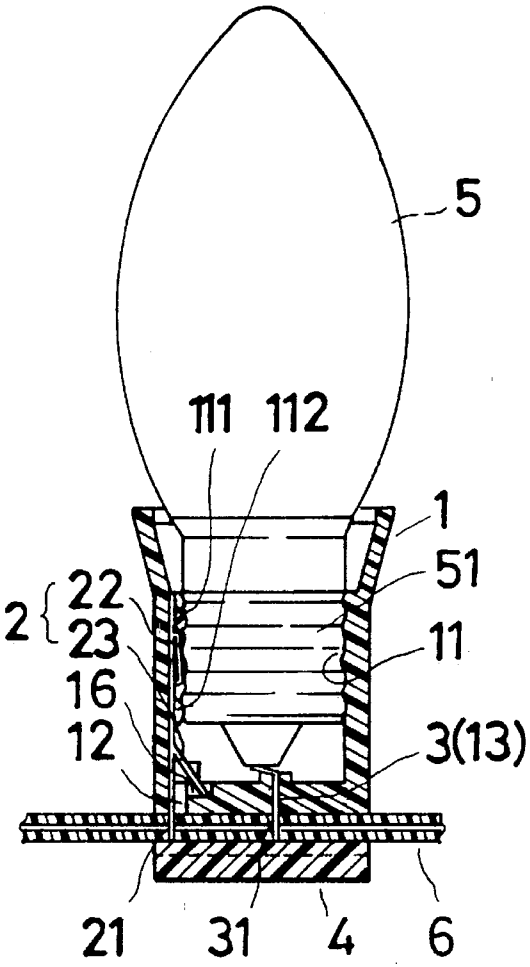
FIG. 3 is a cross-sectional view of the Christmas lamp set of the present invention.
Figure 2:
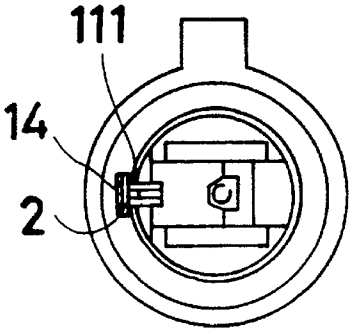
FIG. 2 is top view of the present invention.
Figure 1:
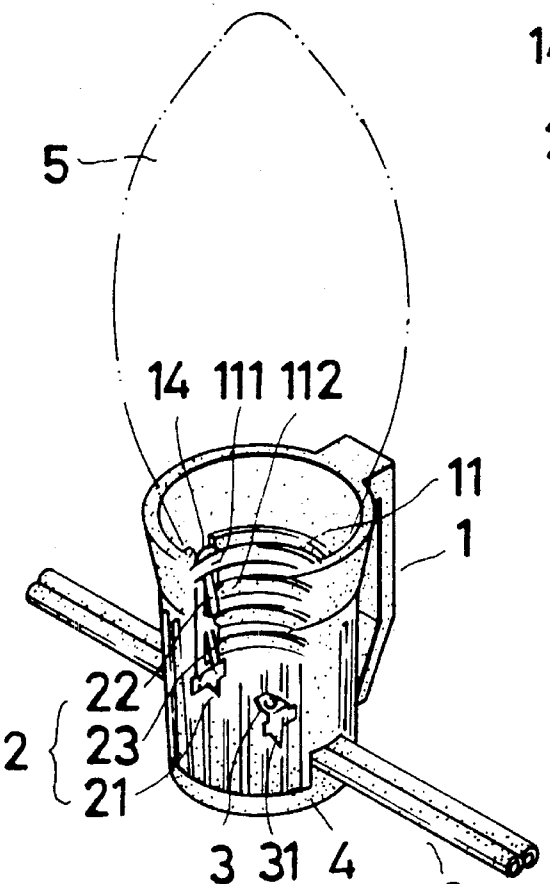
FIG. 1 is a view illustrating the Christmas lamp set of the present invention.
Figure 4:
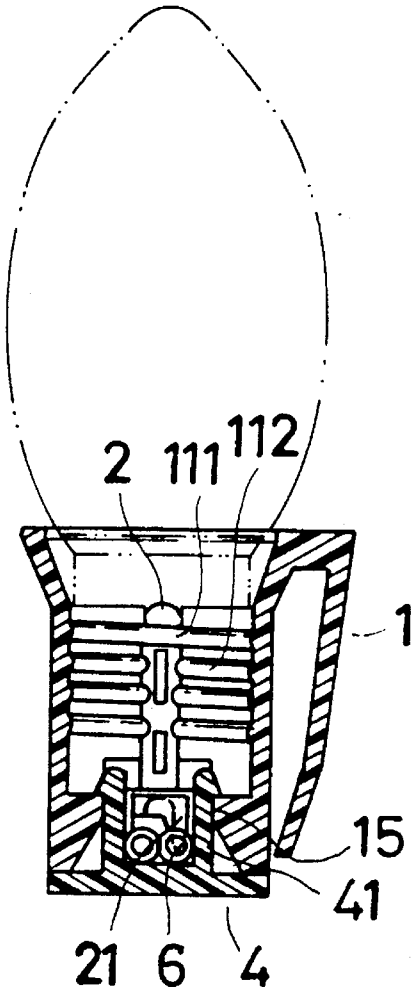
FIG. 4 is another cross-sectional view of the Christmas lamp set in FIG. 3.
Figure 7:
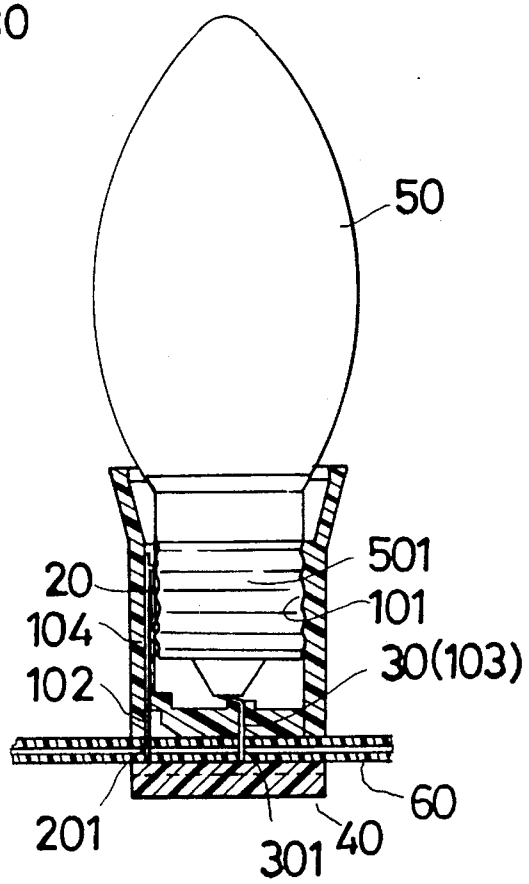
FIG.7 (PRIOR ART)
FIG. 7 is a cross-sectional view of the heretofore known Christmas lamp set.
Figure 6:
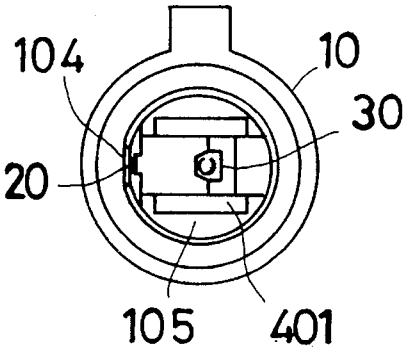
FIG.6 (PRIOR ART)
FIG. 6 is a top view of the heretofore known Christmas lamp set.
Figure 5:
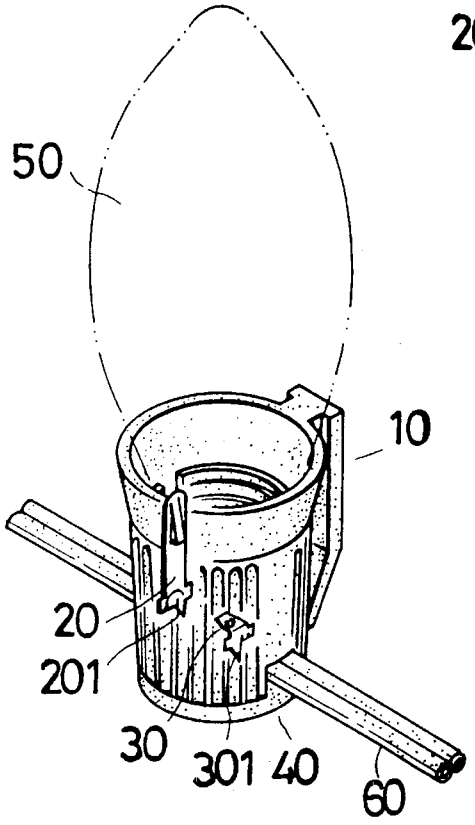
FIG.5 (PRIOR ART)
FIG. 5 is a view illustrating the heretofore known Christmas lamp set described in the background of the invention.

A Christmas lamp set is provided comprising:

- a socket 1 having a threaded wall 11 which is defined by the internal circumference therein and threaded to hold a copper portion 51 of a bulb 5, a trench 14 opened on the threaded wall 11, two through holes 12, 13 on the internal circumference of the bottom part, a pair of fixing holes 15 opened on the lower part thereof;
- a bulb 5 which has a threaded copper portion 51 to be fixed inside the threaded wall 11 of the socket 1;
- a long conductor 2 which has a piercing end 21 and a elastic protrusion 22;
- a short conductor 3 which also has a piercing end 31; and
- a bottom cover 4 which has two fixing bars 41 erecting vertically on the cover 4.

Furthermore the socket is provided with a gap 16 on the lower part thereof and a thread fencing portion 111 and a plurality of threaded retaining portions 112, the thread fencing portion 111 overpassing the upper portion of the trench 14, the thread retaining portions 112 extending from threads of the threaded wall 11 and protruding above the lower portion of the trench 14.

The long conductors 2 further has a stopping protrusion 23 underneath the elastic protrusion 22.

The long conductor 2 is inserted into the trench 14 of the socket 1 and is fenced and secured with the thread fencing portion 111 and the thread retaining portions 112 so that the long conductor 2 won't separate from the trench 14 or be bent.

The piercing end 21 of the long conductor 2 is inserted through the through hole 12 which is just under the trench 14 when the long conductor 2 is inserted into the trench 14, while the stopping protrusion 23 snaps into the gap 16 of the socket 1 due to its elasticity and is retained therein after it is inserted through the through hole 12.

The short conductor 3 is deposited inside the through hole 13 for the piercing end 31 to connect with an electric wire 60 and for the other end bent slightly to connect with the bulb 5.

The electric wire 6 is positioned between the socket 1 and the bottom cover 4 and fixed therein by means of the fixing holes 15 of the a socket 1 and the fixing bars 41 of the bottom cover 4, the fixing bars 41 being inserted into the fixing hole 15 and gripped therein frictionally.

The close combination of the bottom cover 4 with the socket 1 is such that the piercing ends 21, 31 can pierce plastic covers of the electric wire 6 for electricity to be conducted therethrough.

According to the present invention mentioned above, it has the following advantages:

1. the thread fencing portion 111 can prevent the upper portion of the long conductor 2 from separating from the trench 14; thus the risk of its being bent down by the bulb 5 and the consequent connecting with the short conductor 3 is avoided;

2. the thread retaining portions 112 can prevent the long conductor 2 from separating from the trench 14;
3. the application of the gap 16 and the stopping protrusion 23 prevents the long conductor 2 from slipping downward and consequently off the trench 14;
4. the thread fencing portion 111 and the thread retaining portion 112 facilitate the assembly because the bulb 5 can be rotated more smoothly inside the socket 1 than that of the Christmas lamp set described in the background of the invention.

While the preferred embodiments of the invention have been described above, it will be recognized and understood that various modifications may be made therein and the appended claims are intended to cover all such modification which may fall within the spirit and scope of the invention.

What is claimed is:

1. A Christmas lamp set comprising: a socket, a long conductor, a short conductor, a bottom cover, an electric wire and a bulb; the socket being provided with a threaded wall, a trench for holding the long conductor, two through holes for both conductors to be inserted therethrough and two fixing holes for fixing the bottom cover; each of both conductors having a piercing end for connecting with the electric wire to conduct electricity, the short conductor being fixed with one of said through holes to connect with the electric wire and the bulb by means of its piercing end and the other end respectively; after the long conductor is fixed inside the trench with the piercing end being through another of said through holes and after the short conductor is fixed with its upper end bent slightly, the bulb is made to screw into the socket to connect with both conductors, an elastic protrusion being provided on said long conductor to press a copper portion of the bulb by means of its elasticity; then the electric wire is clipped between the socket and the bottom cover so that the piercing ends can piercing is plastic cover to connect with its leads to conduct electricity therethrough; wherein the characteristics are that a thread fencing porting of the threaded wall overpassing the trench is provided to prevent the long conductor from being bent downward when screwing the bulb into the socket.

2. An improvement of claim 1 in which a plurality of thread retaining portions protruding above the trench are provided to prevent the long conductor from separating from the trench.

3. An improvement of claim 1 in which the socket is further provided with a gap while the long conductor is further provided with a stopping protrusion to prevent the long conductor from slipping downward by means of the connection between the gap and the stopping protrusion.

* * * * *